US007327075B2

(12) United States Patent
Kijima et al.

(10) Patent No.: US 7,327,075 B2
(45) Date of Patent: Feb. 5, 2008

(54) IMAGE DISPLAY DEVICE WITH SUPPORT MEMBER BETWEEN FRONT AND REAR SUBSTRATES

(75) Inventors: Yuuichi Kijima, Chosei (JP); Shigemi Hirasawa, Chiba (JP); Yuichi Inoue, Mobara (JP); Akira Hatori, Chiba (JP)

(73) Assignee: Hitachi Displays, Ltd., Mobara-shi (JP)

( * ) Notice: Subject to any disclaimer, the term of this patent is extended or adjusted under 35 U.S.C. 154(b) by 21 days.

(21) Appl. No.: 11/208,604

(22) Filed: Aug. 23, 2005

(65) Prior Publication Data

US 2006/0038481 A1 Feb. 23, 2006

(30) Foreign Application Priority Data

Aug. 23, 2004 (JP) ..... 2004-242397

(51) Int. Cl.
*H01J 1/88* (2006.01)

(52) U.S. Cl. ..... 313/292; 313/495

(58) Field of Classification Search ..... 313/292, 313/317

See application file for complete search history.

(56) References Cited

U.S. PATENT DOCUMENTS

2004/0070331 A1* 4/2004 Kuno et al. ..... 313/495
2005/0023975 A1* 2/2005 Lee et al. ..... 313/512

FOREIGN PATENT DOCUMENTS

JP 7-302558 11/1995

* cited by examiner

*Primary Examiner*—Karabi Guharay
*Assistant Examiner*—Britt Hanley
(74) *Attorney, Agent, or Firm*—Antonelli, Terry, Stout & Kraus, LLP.

(57) ABSTRACT

An image display device includes a front substrate having anodes and phosphors, a rear substrate having plural video signal wirings or lines and plural electron sources each formed on a corresponding one of the video signal wirings or lines, and disposed to face the front substrate with a predetermined spacing between the front and rear substrates and a support member which is sandwiched between the front and rear substrates, surrounds a display area formed therebetween and maintains the predetermined spacing. The support member is includes long-side portions of a uniform width disposed on long sides of the front substrate and short-side portions of a uniform width disposed on short sides of the front substrate. At least the long-side portions are curved convexly toward an outside of the display area.

7 Claims, 6 Drawing Sheets

IMAGE DISPLAY DEVICE WITH SUPPORT MEMBER BETWEEN FRONT AND REAR SUBSTRATES

CLAIM OF PRIORITY

The present application claims priority from Japanese application serial no. 2004-242397, filed on Aug. 23, 2004, the content of which is hereby incorporated by reference into this application.

BACKGROUND OF THE INVENTION

The present invention relates to an image display device which utilizes emission of electrons into a vacuum produced between a front substrate and a rear substrate, and in particular to a configuration of a support member which seals and supports the front and rear substrates with a desired spacing therebetween.

Conventionally, color cathode ray tubes have been widely used as display devices excellent in producing high-brightness high-definition display devices. However, as the video quality in information processing equipment and TV broadcasts has been improved in recent years, the demand has been becoming stronger for flat panel display devices capable of realizing lighter weight and thinner profile in addition to the performance of high brightness and high definition. As their typical examples, liquid crystal display devices and plasma display devices have been put to practical use.

Further, various types of flat panel type display devices are under development for practical use. Especially as display devices capable of realizing higher brightness, image display devices are being developed which utilize emission of electrons into a vacuum from an electron source (for example, they are ones called electron-emission type display devices, field emission type display devices or FEDs). Organic electroluminescent (EL) display devices are also being developed which feature low power consumption.

Among the display devices utilizing the emission of electrons, of such flat panel type display devices, known are one employing an electron-emitting structure invented by C. A. Spindt et al.; one employing an electron-emitting structure of the metal-insulator-metal (MIM) type; one employing an electron-emitting structure utilizing an electron emission phenomenon due to the tunnel effect in the quantum theory (this electron-emitting structure is sometimes called the surface conduction type electron source); and one employing an electron-emitting structure utilizing an electron emission phenomenon exhibited by a diamond film, a graphite film or carbon nanotubes.

Among these flat panel type display devices, an electron-emission type image display device has a rear substrate having, on an inner surface thereof, cathode wirings or lines provided with electron-emission type electron sources and control electrodes, and a front substrate having anodes and phosphors on an inner surface thereof opposing the rear substrate. The front and rear substrates are attached together with a support member sandwiched between their peripheries, and are hermetically sealed to form a panel. The airtight space within the panel is exhausted to a pressure lower than the atmospheric pressure or to a vacuum. The control electrodes are disposed such that the direction of extension of the control electrodes is intersect the direction of extension of the cathode wirings with an insulating layer or an insulating spacing interposed between the control electrodes and the cathode wirings. Further, to maintain the spacing between the rear and front substrates at a desired value, spacing-maintaining members are interposed between the rear and front substrates. The spacing-maintaining members are formed of thin plates of glass or ceramics, for example, and are stood upright and clear of pixels.

FIG. 8 is a cross-sectional view of a major portion of an image display device serving as an example of conventional flat panel type display devices of this kind. This image display device comprises: a rear plate (a rear substrate) 2 having a plurality of electron-emissive elements 5 thereon; a front plate (a front substrate) 1 disposed to oppose the rear plate 2 and having thereon image-forming members 6 which form images by radiation of electron rays emitted from electron-emissive elements 5; a support frame 3 which is sandwiched between the front plate 1 and the rear plate 2, and supports peripheral portions of the front plate 1 and the rear plate 2; and spacers (spacing-maintaining members) 4 disposed between the front plate 1 and the rear plate 2 so as to serve as props. The front plate 1 and the support frame 3, the front plate 1 and top ends of the spacers 4, the rear plate 2 and the support frame 3, the rear plate 2 and bottom ends of the spacers 4 are fixed together by using glass frit 7, respectively.

In a case where the width of peripheral portions of the support frame 3 is reduced as a means for reducing the weight of an image forming device having a large-sized screen, known is a method which makes outer sides of peripheral portions of a support frame 3 convex toward the outside of a display area of the image forming device without making the width of the peripheral portions of the support frame 3 uniform, but with the corner portions being formed to have the minimum width, as shown in a perspective view of its major portion illustrated in FIG. 9. The image-forming device of this kind is disclosed in Japanese Patent Application Laid-Open Publication No. Hei 7-302558.

SUMMARY OF THE INVENTION

There have been problems with the image display device disclosed in the above-mentioned Japanese Patent Application Laid-Open Publication No. Hei 7-302558 in that making only the outer sides of the peripheral portions of the support frame 3 convex causes difficulties in shaping of the support frame 3, and consequently results in increase in its manufacturing cost.

Further, in the image display device shown in FIG. 8, the interior of the panel formed of the front plate 1, the rear plate 2 and the support frame 3 is maintained at a high vacuum in a range of from about $10^{-9}$ Torr to about $10^{-6}$ Torr so as to operate the electron-emissive elements 5, and therefore it is necessary that the structure of the vacuum envelope is capable of sufficiently withstanding atmospheric pressure. Generally, for the purpose of improving the degree of vacuum in the interior of the panel, it is necessary to raise a baking temperature during evacuation of the panel. If the baking temperature during the evacuation process is raised, the glass frit 7 softens, the support frame 3 moves easily, and consequently the support frame 3 is subjected to vacuum stress. At this time the long-side portions or the short-side portions of the support frame 3 deform toward the central portion of the panel due to vacuum stress, and the support frame 3 exhibits the shape of a pincushion. This deformation produces stresses at the corners of the support frame 3, and as a result air leakage occurs easily at the corners of the support frame 3. It is necessary for preventing the air leakage to increase the mechanical strength of the support frame 3.

Accordingly, the present invention has been made to solve the above-mentioned conventional problems, and it is an object of the present invention to prove an image display device capable of reducing air leakage by employing a simple configuration, and realizing its cost.

(1) To achieve the above-mentioned object, in accordance with an embodiment of the present invention, there is provided an image display device comprising: a front substrate having anodes and phosphors on an inner surface thereof; a rear substrate having, on an inner surface thereof, a plurality of video signal wirings or lines and a plurality of electron sources each formed on a corresponding one of said plurality of video signal wirings or lines, and disposed to face said front substrate with a predetermined spacing between said rear substrate and said front substrate; and a support member which is sandwiched between said front substrate and said rear substrate, surrounds a display area formed therebetween and maintains said predetermined spacing, wherein said support member is comprised of long-side portions of a uniform width disposed on long sides of said front substrate and short-side portions of a uniform width disposed on short sides of said front substrate, and at least said long-side portions are curved convexly toward an outside of said display area.

(2) To achieve the above-mentioned object, in accordance with an embodiment of the present invention, there is provided an image display device of the above configuration (1), wherein a radius of curvature of said long-side portions is smaller than that of said short-side portions.

(3) To achieve the above-mentioned object, in accordance with an embodiment of the present invention, there is provided an image display device of the above configuration (2), wherein said radius of curvature of said long-side portions satisfies the following relationship: $5<R/I<50$, where I is a length of said long-side portions as measured on the inside.

(4) To achieve the above-mentioned object, in accordance with an embodiment of the present invention, there is provided an image display device of the above configuration (1), wherein said support member is comprised of a combination of a plurality of curved segments.

(5) To achieve the above-mentioned object, in accordance with an embodiment of the present invention, there is provided an image display device of the above configuration (2), wherein said support member is comprised of a combination of a plurality of curved segments.

(6) To achieve the above-mentioned object, in accordance with an embodiment of the present invention, there is provided an image display device of the above configuration (3), wherein said support member is comprised of a combination of a plurality of curved segments.

(7) To achieve the above-mentioned object, in accordance with an embodiment of the present invention, there is provided an image display device of one of the above configurations (4), (5) and (6), wherein mutually opposing end faces of said plurality of curved segments are not perpendicular to a plane containing axes a and b, or a plane containing said axis b and an axis c, where said axis a is taken as a longitudinal direction of a corresponding one of said plurality of curved segments, said axis b is taken as a direction of a width of said corresponding one of said plurality of curved segments, and said axis c is taken as a direction perpendicular to said plane containing said axes a and b, in a system of rectangular co-ordinates.

(8) To achieve the above-mentioned object, in accordance with an embodiment of the present invention, there is provided an image display device comprising: a front substrate having anodes and phosphors on an inner surface thereof; a rear substrate having, on an inner surface thereof, a plurality of video signal wirings or lines and a plurality of electron sources each formed on a corresponding one of said plurality of video signal wirings or lines, and disposed to face said front substrate with a predetermined spacing between said rear substrate and said front substrate; and a support member which is sandwiched between said front substrate and said rear substrate, surrounds a display area formed therebetween and maintains said predetermined spacing, wherein said support member is comprised of long-side portions disposed on long sides of said front substrate and short-side portions disposed on short sides of said front substrate, and at least sides of said long-side portions facing toward said display area are curved convexly toward an outside of said display area.

Incidentally, it is needless to say that the present invention is not limited to the above-described configurations or the configurations of the embodiments to be described subsequently, but various changes and modifications can be made without departing from the true spirit and scope of the present invention.

The present invention reduces the amount of deformation produced in the long-side and short-side portions of the support frame by vacuum stresses by making the widths of the long-side and short-side portions of the support frame uniform and curving at least the long-side portions convexly toward the outside of the panel, and therefore the present invention can relieve influences of the concentration of stresses on the corners of the support frame greatly, and can reduce the occurrences of air leakage remarkably. Consequently, the present invention provides extremely superior advantages of improving reliability of the display device greatly by employing a simple configuration and realizing the reduction of the cost.

BRIEF DESCRIPTION OF THE DRAWINGS

In the accompanying drawings, in which like reference numerals designate similar components throughout the figures, and in which:

FIG. 6(*b*) is a perspective view of a frame glass-segment forming the support frame shown in FIG. 6(*a*) for explaining its end portions of the frame glass-segment;

DETAILED DESCRIPTION OF THE PREFERRED EMBODIMENTS

In the following the concrete embodiments of the present invention will be explained in detail by reference to the drawings.

Embodiment 1

Figure 1:
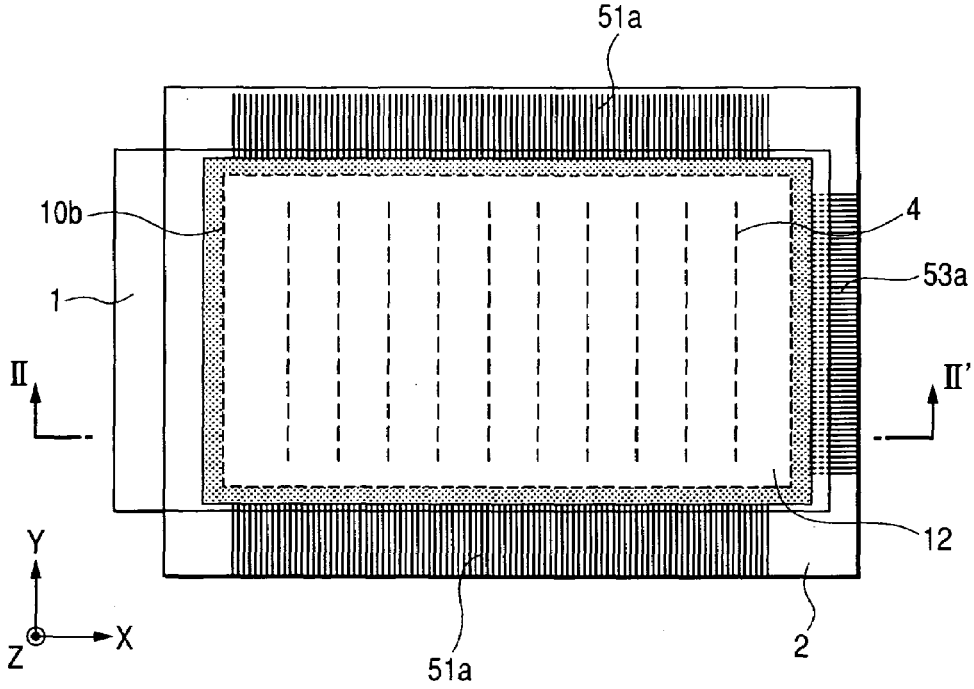
FIG. 1 is a schematic plan view illustrating a configuration of Embodiment 1 of the image display device in accordance with the present invention.
Figure 2:
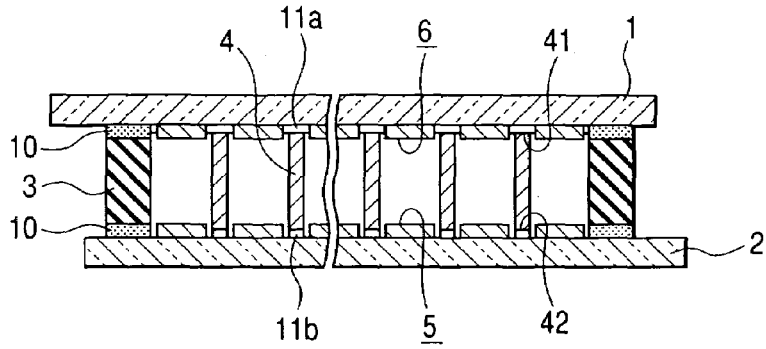
FIG. 2 is a schematic cross-sectional view of the image display device taken along line II-II' of FIG. 1.

FIG. 1 is a plan view of a major portion of an electron-emission type display device in accordance with an embodiment of the image display device of the present invention for explaining the rough configuration of the electron-emission type display device, and FIG. 2 is an enlarged cross-sectional view of the major portion of the electron-emission type display device of FIG. 1 taken along line II-II' of FIG. 1. In FIGS. 1 and 2, reference numeral 1 denotes a front substrate comprised of light-transmissive glass plate, 2 is a rear substrate comprised of a light-transmissive glass plate as in the case of the front substrate, or is comprised of a ceramic plate such as an alumina plate. Consider the front substrate 1 and the rear substrate 2 having a diagonal dimension in a range of from about 32 inches (about 813 mm) to about 50 inches (about 1270 mm). (By way of example, in the case of the substrates of 32 inches in diagonal, the size of the substrates is 800 mm×500 mm.) The thickness of the substrates is usually selected in a range of from 1.5 mm to 5.0 mm, and for example, the substrates are comprised of insulating substrates of about 3 mm in thickness. Reference numeral 3 denotes a support frame which is a supporting member shaped from glass or glass frit material and also serves as part of an envelope. The support frame 3 is sandwiched between the front substrate 1 and the rear substrate 2, and is fixed to their peripheries by using adhesive. The support frame 3 maintains the spacing between the front substrate 1 and the rear substrate 2 at a desired dimension, about 3 mm, for example.

Figure 3:
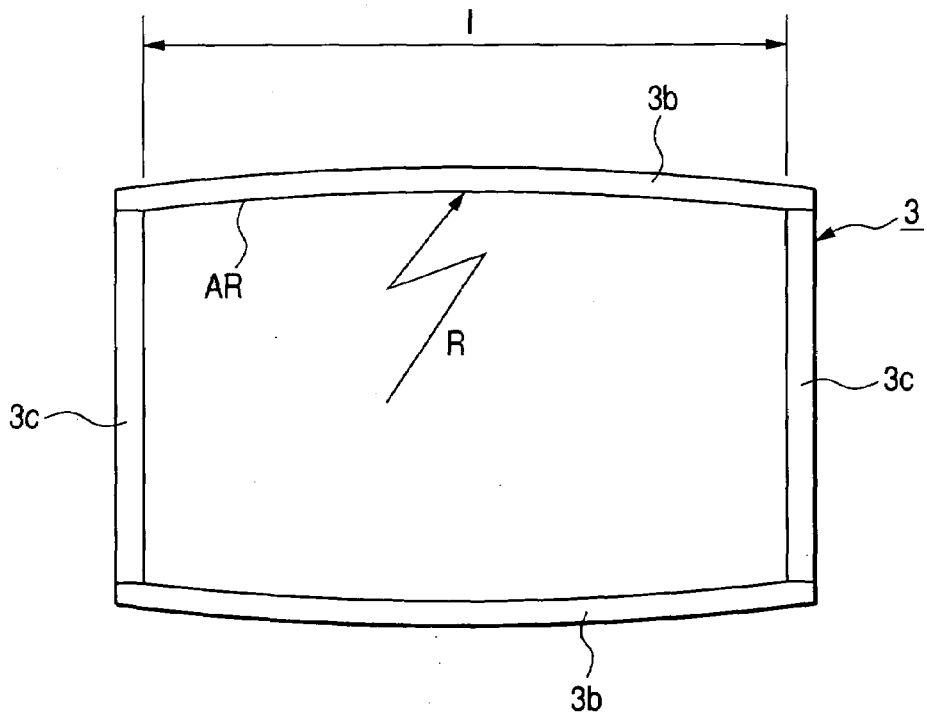
FIG. 3 is a plan view of an essential portion of a support frame shown in FIG. 1 for explaining its configuration.
Figure 4A:
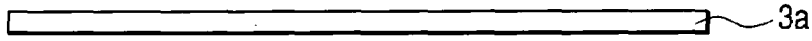
FIGS. 4(*a*) and 4(*b*) are plan views for explaining a method of fabricating the support frame shown in FIG. 1.
Figure 4B:
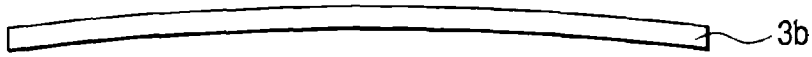

As shown in FIG. 3, the support frame 3 comprises long-side portions corresponding to the horizontal direction of a display area and short-side portions corresponding to the vertical direction of the display area. The width of the long-side and short-side portions is usually selected to be in a range of from 2 mm to 10 mm, and for example, the uniform width of about 6 mm is adopted. The thickness of the long-side and short-side portions is usually selected to be in a range of from 2 mm to 5 mm, and for example, the thickness is selected to be 3 mm to obtain a rectangular bar. Each of the long-side portions of the support frame 3 is comprised of a glass bar curved to be convex outwardly, and each of the short-side portions of the support frame 3 is comprised of a straight glass bar. The long-side portion of the support frame 3 is fabricated by preparing the straight bar-like glass 3*a* of a uniform width as shown in FIG. 4(*a*), and then curving the straight bar-like glass 3*a* by heating at appropriate temperatures to obtain the curved glass 3*b* having a specified radius of curvature as shown in FIG. 4(*b*).

Next, as shown in FIG. 3, the two curved glasses 3*b* and the two straight bar-like glasses 3*c* for the short-side portions are arranged at top and bottom sides of a rectangle and at left and right sides of the rectangle, respectively, to form a peripheral frame, and then are fixed together by using noncrystalline glass frit, for example, to form the support frame 3. It is preferable that the radius of curvature, R, of the long-side portions of the support frame 3 satisfies the following relationship:

$$5<R/I<50,$$

where I is a length of the long-side portions as measured on the inside. In this case, the curvature of each of the long-side portions of the support frame 3 is not limited to one represented by a single radius of curvature R, but may be one represented by plural radii of curvature.

In FIG. 2, reference numeral 4 denotes plate-like spacers which serve as spacing-maintaining members. The spacer 4 is formed by cutting a thin glass plate or a thin ceramic plate such as an alumina plate of about 0.1 mm, for example, to pieces of about 3 mm in width (which corresponds to a height of the spacer 4). The plural spacers 4 are disposed to stand approximately upright on the major surfaces of the front substrate 1 and the rear substrate 2, to extend in one direction (a Y direction), and to be arranged in another direction (an X direction). The plural spacers maintain the spacing between the front substrate 1 and the rear substrate 2 at a desired value in cooperation with the support frame 3.

Reference 5 denotes electron-emissive elements, each of which comprises a corresponding one of video signal wirings or lines, an electron source and a corresponding one of scan signal wirings or lines. The electron-emissive elements 5 are arranged at specified intervals on the rear substrate 2. The plural video signal wirings extend in one direction (a Y direction) on an inner surface of the rear surface 2, and are arranged in another direction (an X direction). The video signal wirings are divided into two groups. Ends of the video signal wirings of one of the two groups are brought out of a hermetic sealing portion on one side of the rear substrate 2 so as to serve as leads 51*a* for the video signal wirings of the one group, and ends of the video signal wirings of the other of the two groups are also brought out of the hermetic sealing portion on another side of the rear substrate 2 so as to serve as leads 51*a* for the video signal wirings of the other group. The video signal wirings are formed by using evaporation, for example, or they are formed by thick-film printing a silver paste comprised of conductive silver particles of about 1 μm to about 5 μm in diameter and an insulating low-melting glass, for example, and then firing the silver paste at about 600° C., for example.

The scan signal wirings or lines are disposed above the video signal wirings or lines and are insulated therefrom, and ends of the scan signal lines are brought out of the hermetic sealing portion on the remaining side of the rear substrate 2 so as to serve as leads 53*a* for the scan signal wirings of the other group. The electron sources are arranged at specified intervals on the video signal wirings, and are comprised of electron-emissive elements of the metal-insulator-metal (MIM) type.

Reference numeral 6 denotes image-forming members, each of which is comprised of a phosphor film, a metal back film deposited on the phosphor film and a black matrix (BM) film. The image-forming members 6 are disposed on an inner surface of the front substrate 1.

Reference numeral 10 denotes a sealing member which seals together the rear substrate 2 and one end of the support frame 3. For example, the sealing member 10 is formed of noncrystalline glass frit which comprises PbO in a range of from about 75 wt % to about 80 wt %, $B_2O_3$ of about 10 wt %, and the remainder in a range of from 10 wt % to 15 wt %. The sealing members 10 are disposed on the top and bottom ends of the support frame 3 so as to hermetically seal together the peripheries of the front substrate 1 and the rear substrate 2 stacked in a Z direction in FIG. 1. A region enclosed by the support frame 3, the front substrate 1 and the rear substrate 2 forms a display region 12 (see FIG. 1), and the interior of the display region 12 is maintained at a vacuum state.

The hermetic sealing employing the sealing member 10 is performed in a nitrogen atmosphere, for example, at about 430° C., for example. Thereafter, the assembly is evacuated to vacuum while heated at about 350° C., and then is sealed off. Incidentally the Z direction is taken as a direction perpendicular to the stacked front and rear substrates 1, 2.

Reference numerals 11*a* and 11*b* denote fixing members which fix the spacers 4 and the front substrate 1 together, and the spacers 4 and the rear substrate 2 together, respectively. Of the fixing members 11*a* and 11*b*, the fixing members 11*a* for fixing together the front substrate 1 and the spacers 4 are formed of crystallized glass frit composed chiefly of $B_2O_3$, PbO and ZnO, for example, and fix together the front substrate 1 and top ends 41 of the spacers 4. The fixing members 11*b* for fixing together the rear substrate 2 and the spacers 4 are formed of noncrystalline glass frit composed chiefly of $SiO_2$, $B_2O_3$ and PbO, for example, and fix together the rear substrate 2 and bottom ends 42 of the spacers 4.

With the above configuration, electrons emitted from the electron sources disposed on the video signal wirings are controlled by the scan signal wirings supplied with required drive voltages, travel toward the image-forming members supplied with an anode voltage of about several kilovolts to about 10 kilovolts, pass through the metal back film (the anode), and impinge upon the phosphor films to emit light, thereby producing a desired display on a viewing screen. A unit pixel is formed in the vicinity of each of intersections of the video signal wirings and the scan signal wirings to form a matrix array, and the pixels arranged in a matrix fashion form the display region. Generally, a group formed of three unit pixels forms a color pixel comprised of red (R), green (G) and blue (B).

In the image display device of the above configuration, the support frame 3 has the long-side portions and the short-side portions of a uniform width, and the long-side portions disposed at the top and bottom sides of the substrates are curved convexly outwardly. With this configuration, the vacuum stresses are uniformly dispersed and absorbed by the long-side portions disposed at the top and bottom sides of the substrates, and consequently, the amount of deformation of the support frame 3 caused by vacuum stresses is reduced, influences of the vacuum stresses on the corners of the support frame 3 are greatly relieved, and occurrences of air leakage at the corners of the support frame can be reduced greatly. Although the width of the corners of the support frame is made uniform, the concentration of vacuum stresses does not occur at the corners of the support frame, and are less susceptible to occurrences of air leakage at the corners of the support frame. Further, there is no danger that cracks or air leakage occurs at the hermetic sealing portions.

In the above explanation, the radius of curvature, R, of the long-side portions of the support frame 3 is described as satisfying the relationship of $5<R/I<50$, where I is a length of the long-side portions as measured on the inside.

In this example, the length I of the long-side portions is selected to be about 400 mm, and the long-side portions are curved to protrude outwardly by about 1 mm.

If the radius R of curvature of the long-side portions is selected to be greater than 20,000 mm, or to satisfy $R/I>50$, then deformation of the support frame 3 is caused by the vacuum stresses, and air leakage easily occurs at the corners of the support frame 3. Further, if the radius R of curvature of the long-side portions is selected to be smaller than 2,000 mm, or to satisfy $R/I<50$, then the radius R of curvature of the long-side portions becomes so excessively great that the outside dimensions of the panel becomes too large compared with the effective display region. The results of the experiments by the present inventors showed that it is preferable that the radius of curvature, R of the long-side portions of the support frame 3 is selected to satisfy the relationship of $5<R/I<50$, where I is a length of the long-side portions as measured on the inside.

Figure 5:
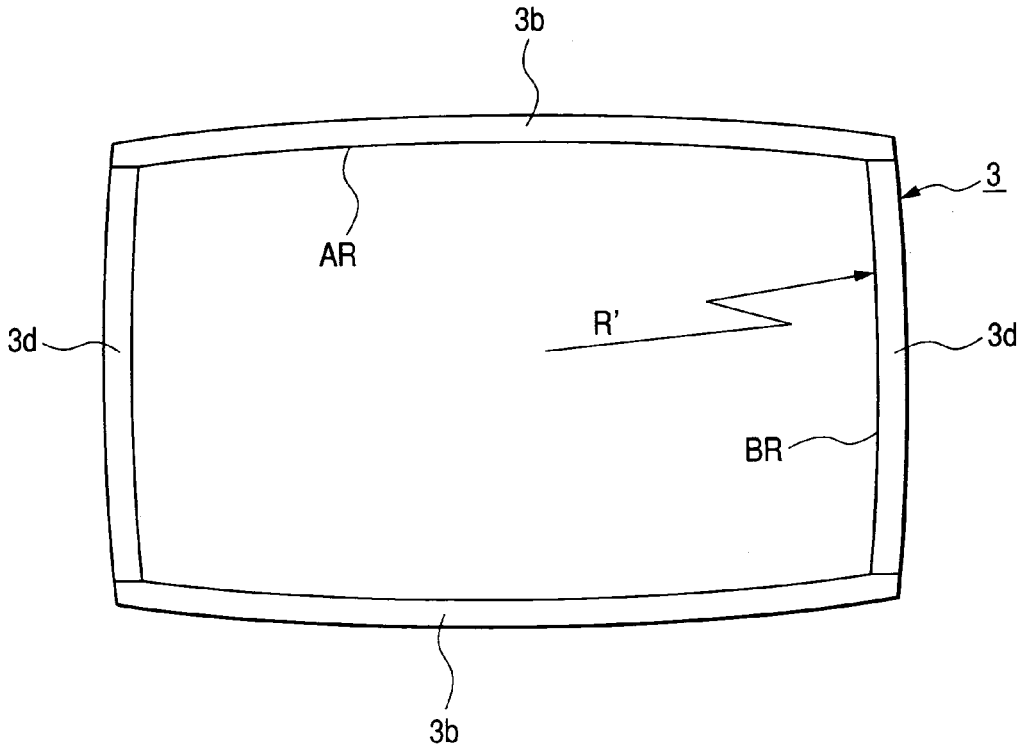
FIG. 5 is a plan view illustrating a configuration of another embodiment of the support frame usable in the image display device in accordance with the present invention.

FIG. 5 is a plan view illustrating a configuration of another embodiment of the support frame usable in the image display device in accordance with the present invention. The support frame 3 of FIG. 5 differs from that of FIG. 3, in that the short-side portions of the support frame 3 are comprised of curved glasses 3*d* curved to be convexly outwardly (in a horizontal direction). The radius R' of curvature of each of the curved glasses 3*d* of the short-side portions is selected to be larger than the radius R of curvature of each of the curved glasses 3*b* of the long-side portions.

With this configuration, the support frame 3 is comprised of the long-side portions formed of the curved glasses 3*b* having the radius R of curvature and the short-side portions formed of the curved glasses 3*d* having the radius R' of curvature larger than the radius R of curvature of the curved glasses 3*b*, and consequently, vacuum stresses are uniformly dispersed to and absorbed by the long-side portions and the short-side portions of the support frame 3, the amount of deformation of the respective sides of the support frame 3 produced by vacuum stresses is further reduced, thereby the influences of the vacuum stresses on the corners of the support frame 3 are made extremely small, and occurrence of air leakage can be prevented effectively.

Figure 6A:
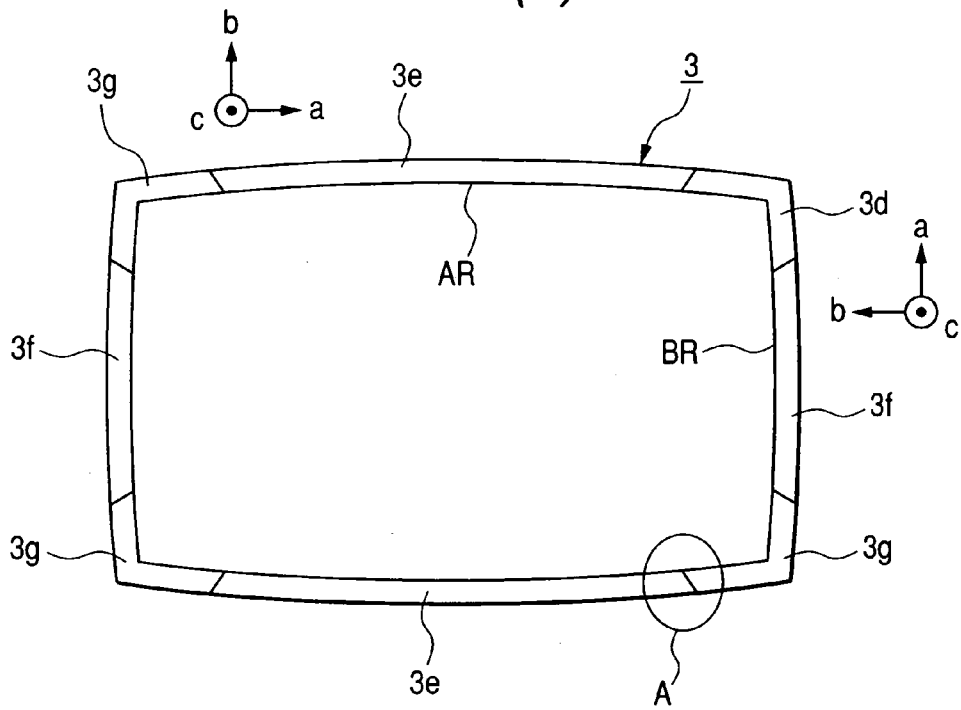
FIG. 6(*a*) is a plan view illustrating a configuration of still another embodiment of the support frame usable in the image display device in accordance with the present invention.
Figure 6B:
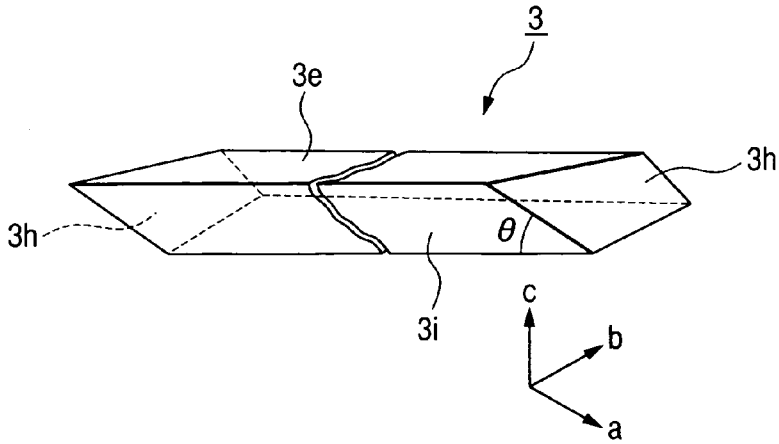

FIGS. 6(*a*) and 6(*b*) are illustrations for explaining a configuration of still another embodiment of the support frame usable in the image display device in accordance with the present invention, FIG. 6(*a*) is a plan view of this embodiment, and FIG. 6(*b*) is an enlarged perspective view of a portion A in FIG. 6(*a*).

As shown in FIG. 6(*a*), the support frame 3 shown in FIGS. 6(*a*) and 6(*b*) differs from that shown in FIG. 3, in that the support frame 3 is divided into the long-side portions, the short-side portions and the corner portions, which are comprised of frame glass-segments 3*e*, frame glass-segments 3*f*, and frame glass-segments 3*g* different in shape from each other, respectively. The frame glass-segments 3*e*, 3*f* and 3*g* are mutually joined at their ends and are fixed together as by noncrystalline glass frit.

In FIGS. 6(*a*) and 6(*b*), the mutually opposing end faces 3*h* of the frame glass-segments 3*e*, 3*f* and 3*g* obtained by dividing the support frame 3 are not perpendicular to a plane containing axes a and b, or a plane containing the axis b and an axis c, where the axis a is taken as a longitudinal direction (a direction of extension) of a corresponding one of the frame glass-segments 3*e*, 3*f* and 3*g*, the axis b is taken as a direction of a width, (a direction perpendicular to the direction of extension), of the corresponding one of the frame glass-segments 3*e*, 3*f* and 3*g*, and the axis c is taken as a direction perpendicular to the plane containing the axes a and b, in a system of rectangular co-ordinates. That is to say, the mutually opposing end faces 3*h* of the frame glass-segments 3*e*, 3*f* and 3*g* are planes obtained by cutting the frame glass-segments 3*e*, 3*f* and 3*g* obliquely and two-dimensionally.

With this configuration, since the mutually opposing end faces 3*h* of the frame glass-segments 3*e*, 3*f* and 3*g* of the support frame 3 are two-dimensionally- and obliquely-cut planes, vacuum stresses are dispersed uniformly to a plane 3*i* (see FIG. 6(*b*)) to which the vacuum stresses are applied, and are relieved, and consequently, the amount of deformation of the support frame 3 due to the vacuum stresses is remarkably reduced and air leakage does not occur easily.

Figure 7A:
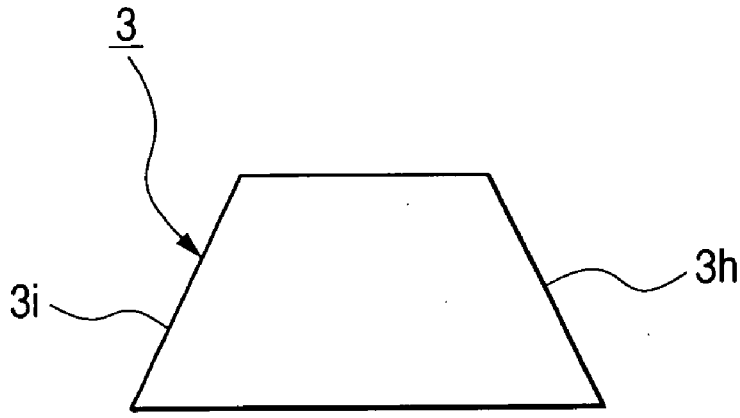
FIGS. 7(*a*) and 7(*b*) are cross-sectional views of end portions of frame glass-segments in other examples of the support frames usable in the image display device in accordance with the present invention, respectively.
Figure 7B:
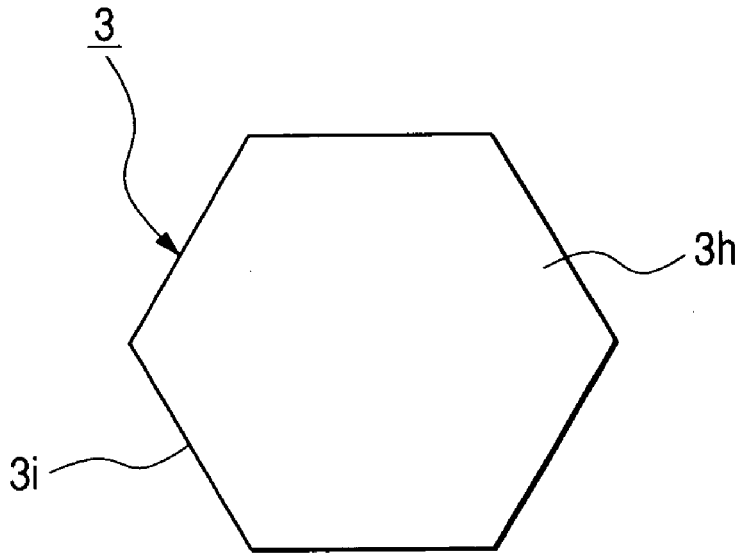
Figure 8:
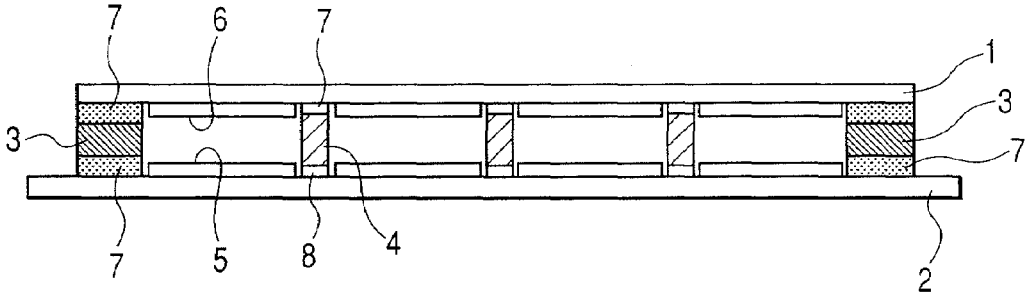
FIG. 8 (PRIOR ART)
FIG. 8 is a cross-sectional view of a major portion of a conventional image display device.
Figure 9:
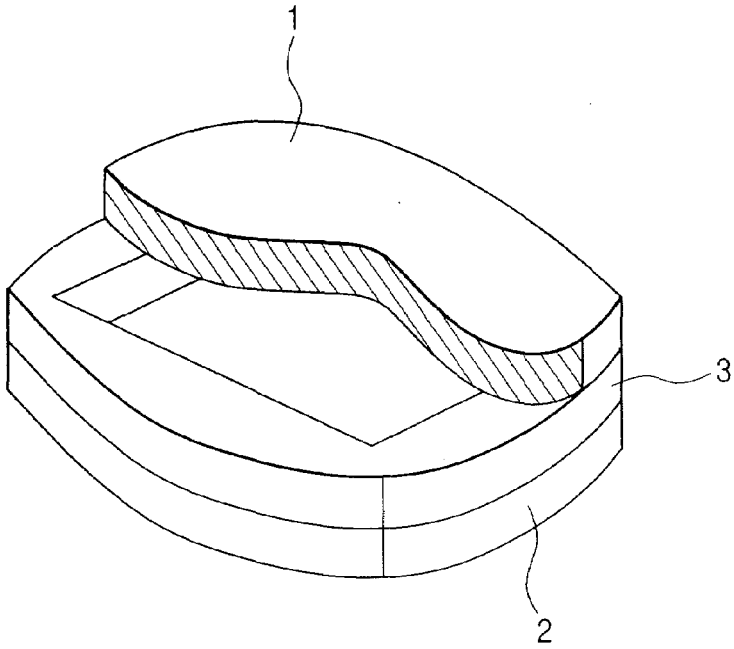
FIG. 9 (PRIOR ART)
FIG. 9 is a perspective view of a major portion of the conventional image display device.

In the above-described embodiments, the shape of the mutually opposing end faces 3*h* of the frame glass-segments 3*e*, 3*f* and 3*g* of the support frame 3 has been explained as being rhombic, and even in a case where the shape of the mutually opposing end faces 3*h* of the frame glass-segments is fabricated as a polygon such as a trapezoid in cross section as shown in FIG. 7(*a*), or such as a hexagon in cross section as shown in FIG. 7(*b*), the vacuum stresses are dispersed uniformly over end faces, and the above-explained advantages are obtained.

In the above explanation, the support member which supports the front and rear substrates to face each other with a specified spacing therebetween has been explained as having the long-side portions and the short-side portions of the uniform width disposed on the long sides and the short sides of the substrates, and as curving at least the long-side portions convexly outwardly. However, according to the acceptable amount of deformation of the support frame which is curved toward the central portion of the panel by vacuum stresses (the amount of deformation of the support frame into the above-mentioned pincushion shape), at least the sides of the support member 3 facing the central portion of the panel may be curved convexly toward the outside of the panel (as indicated by inner curves labeled AR and BR in FIGS. 3, 5 and 6(*a*)), without making the support member 3 uniform in width.

In the above-explained embodiments, the image display device has been explained as one employing the rear substrate provided with electron-emissive elements of the MIM type, and the present invention is not limited to this type, but it is needless to say that even when the present invention is applied to flat panel type display devices employing other types of electron-emissive sources, the above-described advantages are obtained.

What is claimed is:

1. An image display device comprising:

a front substrate having anodes and phosphors on an inner surface thereof;

a rear substrate having, on an inner surface thereof, a plurality of video signal lines and a plurality of electron sources each formed on a corresponding one of said plurality of video signal lines, and disposed to face said front substrate with a predetermined spacing between said rear substrate and said front substrate; and a support member which is sandwiched between said front substrate and said rear substrate, surrounds a display area formed therebetween and maintains said predetermined spacing, wherein said support member is comprised of long-side portions of a uniform width disposed on long sides of said front substrate and short-side portions of a uniform width disposed on short sides of said front substrate, and at least said long-side portions are curved convexly toward an outside of said display area.

2. An image display device according to claim 1, wherein a radius of curvature of said long-side portions is smaller than that of said short-side portions.

3. An image display device according to claim 2, wherein said radius of curvature R of said long-side portions satisfies the following relationship:

$$5<R/I<50,$$

where I is a length of said long-side portions as measured on the inside.

4. An image display device according to claim 1, wherein said support member is comprised of a combination of a plurality of curved segments.

5. An image display device according to claim 2, wherein said support member is comprised of a combination of a plurality of curved segments.

6. An image display device according to claim 3, wherein said support member is comprised of a combination of a plurality of curved segments.

7. An image display device according to claim 3, wherein mutually opposing end faces of said plurality of curved segments are not perpendicular to a plane containing axes a and b, or a plane containing said axis b and an axis c, where said axis a is taken as a longitudinal direction of a corresponding one of said plurality of curved segments, said axis b is taken as a direction of a width of said corresponding one of said plurality of curved segments, and said axis c is taken as a direction perpendicular to said plane containing said axes a and b, in a system of rectangular co-ordinates.

* * * * *